US010136746B2

(12) United States Patent
Truog et al.

(10) Patent No.: US 10,136,746 B2
(45) Date of Patent: Nov. 27, 2018

(54) EATING UTENSIL ASSEMBLY INCLUDING THROUGH-OPENING CARRIED PAIR OF STICKS AND RELATED METHODS

(71) Applicant: SNAP OUT SOLUTIONS, LLC, Lake Mary, FL (US)

(72) Inventors: Kimberly A. Truog, Lake Mary, FL (US); Corbet A. Truog, Lake Mary, FL (US)

(73) Assignee: Snap Out Solutions, LLC, Lake Mary, FL (US)

( * ) Notice: Subject to any disclaimer, the term of this patent is extended or adjusted under 35 U.S.C. 154(b) by 128 days.

(21) Appl. No.: 15/407,936

(22) Filed: Jan. 17, 2017

(65) Prior Publication Data

US 2017/0119184 A1 May 4, 2017

Related U.S. Application Data

(63) Continuation-in-part of application No. 14/540,603, filed on Nov. 13, 2014, now Pat. No. 9,549,626, (Continued)

(51) Int. Cl.

| | |
|---|---|
| ***A47G 21/06*** | (2006.01) |
| ***A47G 21/02*** | (2006.01) |
| ***A47G 21/04*** | (2006.01) |

(52) U.S. Cl.

CPC ..... *A47G 21/06* (2013.01); *A47G 21/02* (2013.01); *A47G 21/04* (2013.01); *A47G 21/103* (2013.01)

(58) Field of Classification Search

CPC .... A47G 21/103; A47G 21/02; A47G 21/023; A47G 21/04; A47G 21/06; A47G 21/10; A47G 21/12

See application file for complete search history.

(56) References Cited

U.S. PATENT DOCUMENTS

| | | | |
|---|---|---|---|
| 33,285 | A | 9/1861 | Ames |
| 34,069 | A | 1/1862 | Neill |

(Continued)

FOREIGN PATENT DOCUMENTS

| | | | |
|---|---|---|---|
| CN | 201551071 | U | 8/2010 |
| CN | 202504912 | U | 10/2012 |

(Continued)

OTHER PUBLICATIONS

English Translation of DE29710423.*

*Primary Examiner* — Jennifer Swinney

(74) *Attorney, Agent, or Firm* — Allen, Dyer, Doppelt + Gilchrist, P.A.

(57) ABSTRACT

An eating utensil assembly may include a first eating utensil including a first handle having a through-opening therein each having a proximal end and enlarged width distal end that is enlarged relative to the proximal end to define a first handle contour and a through-opening contour, respectively. The first handle may also include a first eating utensil head coupled to one of the proximal and distal ends of the first handle. A second eating utensil may be removably carried within the through-opening. The second eating utensil may have a proximal and an enlarged distal end to define a second eating utensil contour. The second eating utensil, first handle, and through-opening contours may match. The second eating utensil may include a pair of sticks each having a tapered shape. Breakaway tabs may removably couple the first and second eating utensils.

23 Claims, 14 Drawing Sheets

Related U.S. Application Data which is a continuation-in-part of application No. 14/096,425, filed on Dec. 4, 2013, now Pat. No. 9,554,663.

(56) References Cited

U.S. PATENT DOCUMENTS

| | | | | |
|---|---|---|---|---|
| 62,640 | A | 3/1867 | Lamson | |
| 147,119 | A | 2/1874 | Francis | |
| 9,687 | A | 5/1881 | Cox | |
| 398,264 | A | 2/1889 | Kisner | |
| 904,553 | A | 11/1908 | McCoy | |
| D53,165 | S | 4/1919 | Janosik | |
| 1,490,785 | A | 4/1924 | Purnell | |
| 1,606,039 | A | 11/1926 | Norman | |
| 1,607,864 | A | 11/1926 | Butler | |
| 2,185,942 | A | 1/1940 | Frank | |
| 2,318,129 | A | 5/1943 | Torode | |
| 2,545,121 | A | 3/1951 | Szopa | |
| 2,877,547 | A | 3/1959 | Feaster | |
| 3,136,416 | A | 6/1964 | Goldrosen | |
| 3,252,489 | A | 5/1966 | Huston et al. | |
| 3,664,020 | A * | 5/1972 | Hammond | A47G 21/02 132/323 |
| 3,783,883 | A | 1/1974 | Alexander | |
| 4,030,194 | A | 6/1977 | Hendricks | |
| D249,926 | S | 10/1978 | Wong | |
| 4,922,611 | A | 5/1990 | Levy | |
| 5,701,675 | A | 12/1997 | Hall et al. | |
| D391,123 | S | 2/1998 | Rey et al. | |
| 5,845,403 | A | 12/1998 | Nivin | |
| 6,003,710 | A | 12/1999 | Huang | |
| 6,371,324 | B1 | 4/2002 | Torniainen et al. | |
| D535,857 | S | 1/2007 | Bristow | |
| D607,285 | S | 1/2010 | Julow | |
| D608,602 | S | 1/2010 | Davies et al. | |
| D609,060 | S | 2/2010 | Pallotto | |
| D610,747 | S | 2/2010 | Brownell | |
| D644,071 | S | 8/2011 | Vanguard | |
| D665,630 | S | 8/2012 | Vasavada | |
| 2007/0033809 | A1 | 2/2007 | Shirazi | |
| 2008/0000092 | A1 | 1/2008 | Vanguard | |
| 2011/0035946 | A1 | 2/2011 | Menceles | |
| 2011/0132392 | A1 * | 6/2011 | Crisp | A46B 15/0055 132/309 |
| 2011/0146082 | A1 | 6/2011 | Hassanpour et al. | |
| 2012/0103356 | A1 * | 5/2012 | Crisp | A46B 15/0055 132/200 |
| 2012/0222311 | A1 * | 9/2012 | Wang | A47G 21/02 30/123 |
| 2013/0232793 | A1 | 9/2013 | Fazal | |
| 2015/0035301 | A1 | 2/2015 | Aghamalian | |
| 2015/0150396 | A1 | 4/2015 | Truog et al. | |

FOREIGN PATENT DOCUMENTS

| | | | | |
|---|---|---|---|---|
| CN | 202959903 | U | 6/2013 | |
| CN | 203106623 | U | 8/2013 | |
| CN | 103385638 | A | 11/2013 | |
| DE | 29710423 | U1 * | 8/1997 | A47G 21/02 |
| DE | 102009030050 | A1 | 3/2011 | |
| EP | 0257109 | A1 | 3/1988 | |
| FR | 461928 | A | 1/1914 | |
| FR | 624152 | A | 7/1927 | |
| JP | 2006296868 | A | 11/2006 | |
| KR | 2019940005199 | Y1 | 8/1994 | |
| KR | 2020080001177 | U | 5/2008 | |
| KR | 2020080001295 | U | 5/2008 | |
| WO | 2011139353 | A1 | 11/2011 | |

* cited by examiner

EATING UTENSIL ASSEMBLY INCLUDING THROUGH-OPENING CARRIED PAIR OF STICKS AND RELATED METHODS

RELATED APPLICATIONS

The present application is a continuation-in-part of application Ser. No. 14/540,603 filed on Nov. 13, 2014, now U.S. Pat. No. 9,549,626 issued Jan. 24, 2017, which is a continuation-in-part of application Ser. No. 14/096,425, filed Dec. 4, 2013, now U.S. Pat. No. 9,554,663 issued Jan. 31, 2017, the entire contents of each are herein incorporated in their entirety by reference.

TECHNICAL FIELD

The present application is directed to utensils, and more particularly, to eating utensils and related methods.

BACKGROUND

An eating utensil is a common tool for cutting and eating food. For example, an eating utensil, which may be considered a form of cutlery, may include a fork, knife, or spoon. A fork, for example, typically includes a handle and tines extending outwardly from the handle. A spoon typically includes a handle and a relatively small oval or round bowl coupled to an end of the handle. A knife also typically includes a handle and a cutting blade at an end of the handle.

Traditionally, the knife, fork, and spoon are separate utensils. In other words, for each eating function, there is typically a corresponding utensil. Over time, the shape and size of an eating utensil has changed, for example, based upon a type of use (e.g., single or multi-use), type of food, etc.

One such change to the shape or size of a typical eating utensil has been to combine eating utensils so that a single eating utensil has both the shape and function of what has been traditionally a single eating utensil. For example, a spork is a combination spoon and fork, a sporf is a combination spoon, fork, and knife, a splayd is a combination spoon, fork, and knife, and a spife is a combination spoon and knife.

SUMMARY

An eating utensil assembly may include a first eating utensil that includes a first handle having a through-opening therein. The first handle and the through-opening may each have a proximal end and enlarged width distal end that is enlarged relative to the proximal end to define a first handle contour and a through-opening contour, respectively, the first handle contour matching the through-opening contour. The first handle may also include a first eating utensil head coupled to one of the proximal and distal ends of the first handle. The eating utensil assembly may also include a second eating utensil removably carried by the first eating utensil within the through-opening in the first handle. The second eating utensil may have a distal end and an enlarged proximal end that is enlarged relative to the distal end of the second eating utensil to define a second eating utensil contour. The second eating utensil contour may match the first handle and through-opening contours. The second eating utensil may include a pair of sticks each having a tapered shape. The eating utensil assembly may also include a plurality of breakaway tabs removably coupling the second eating utensil to the first eating utensil. Accordingly, the eating utensil assembly may provide increased user convenience and eating efficiency. For example, the eating utensil assembly may be used instead of a separately packaged chopsticks and fork, and this may also reduce waste.

Each of the pair of sticks may have a same length, for example. The pair of sticks may be coupled together adjacent the enlarged width proximal end thereof.

The pair of sticks may be spaced apart from each other adjacent the distal end thereof. The second eating utensil may define a monolithic unit, for example.

The second eating utensil may extend a length of the first handle from the proximal end of the through-opening to the enlarged width distal end of the through-opening. The plurality of breakaway tabs, the first eating utensil, and the second eating utensil may define a monolithic unit.

The plurality of breakaway tabs may be spaced apart between the second eating utensil and the first eating utensil along a perimeter of the through-opening. The second eating utensil may be removably carried within the through-opening flush with an upper surface of the first handle, for example.

The first eating utensil head may have a curved shape. The first eating utensil head may include a plurality of tines, for example. The first eating utensil head may include a rounded container.

A method aspect is directed to a method of making an eating utensil assembly. The method may include forming a first eating utensil that includes a first handle having a through-opening therein. The first handle and the through-opening each have a proximal end and enlarged width distal end that is enlarged relative to the proximal end to define a first handle contour and a through-opening contour, respectively. The first handle contour matches the through-opening contour, and a first eating utensil head is coupled to one of the proximal and distal ends of the first handle. The method also includes forming a second eating utensil removably carried by the first eating utensil within the through-opening in the first handle. The second eating utensil may have a distal end and an enlarged proximal end that is enlarged relative to the distal end of the second eating utensil to define a second eating utensil contour. The second eating utensil contour may match the first handle and through-opening contours. The second eating utensil may include a pair of sticks each having a tapered shape. The method may also include forming a plurality of breakaway tabs to removably couple the second eating utensil to the first eating utensil.

DETAILED DESCRIPTION

Figure 1:
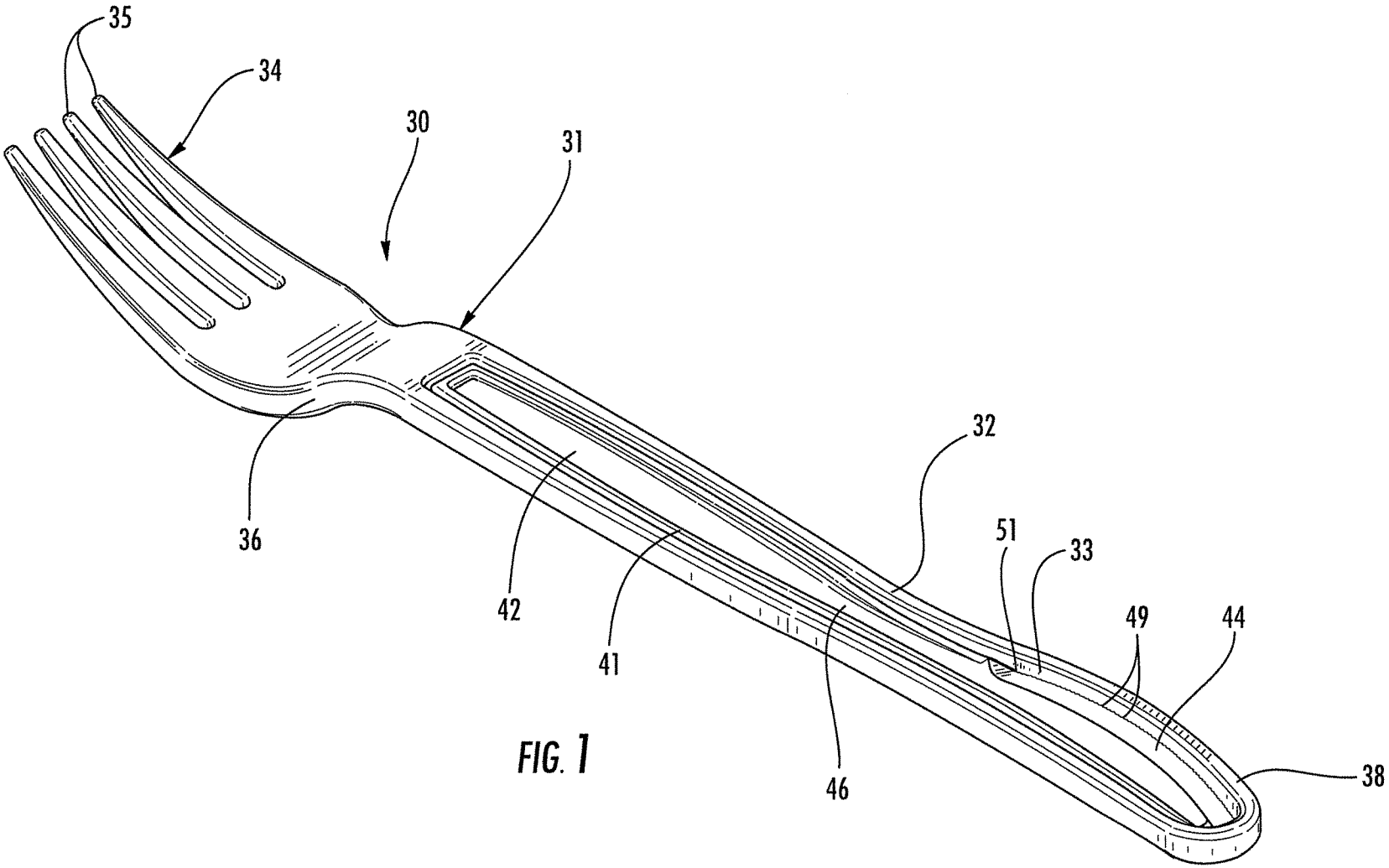
FIG. 1 is an enlarged perspective view of an eating utensil assembly according to an embodiment.
Figure 2:
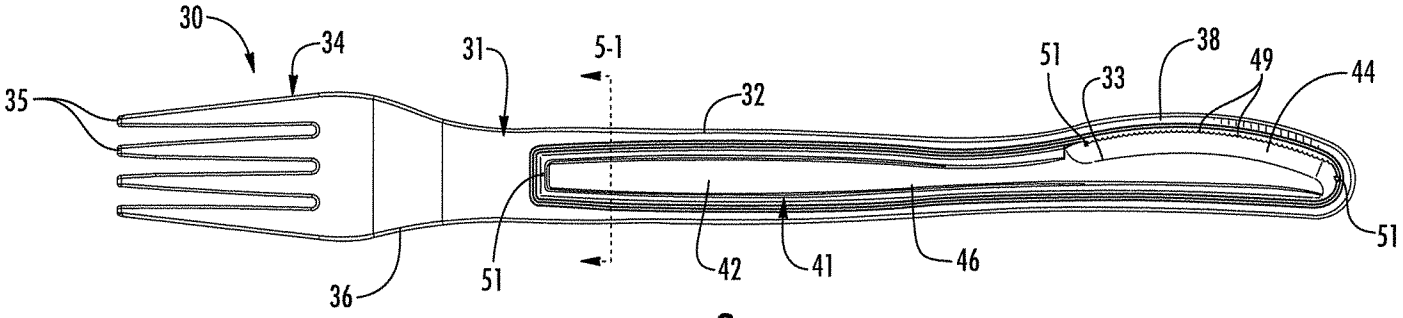
FIG. 2 is a top view of the eating utensil assembly of FIG. 1.
Figure 3:
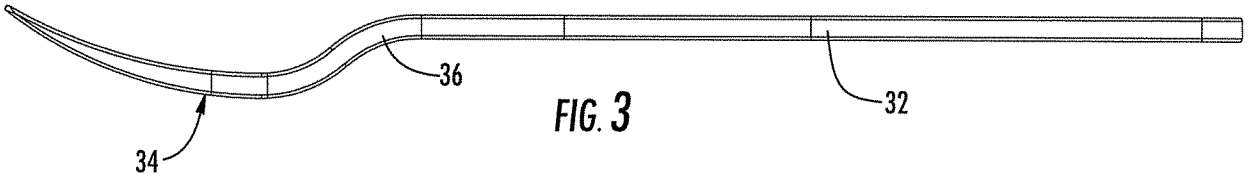
FIG. 3 is a side view of the eating utensil assembly of FIG. 1.
Figure 4:
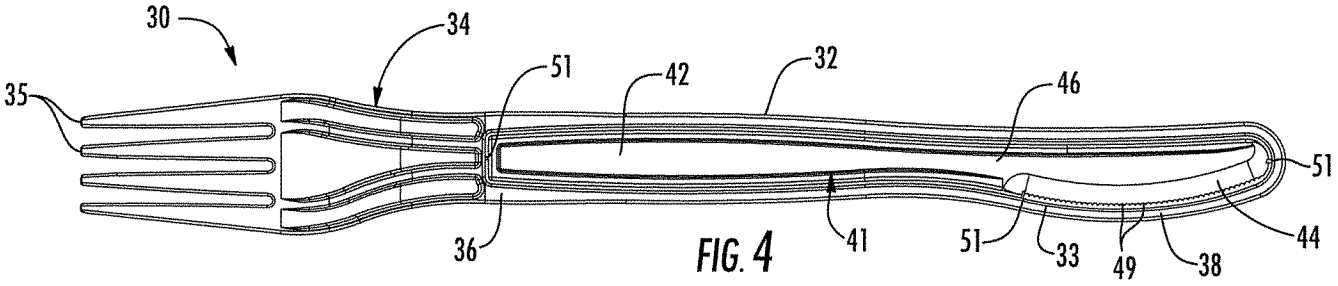
FIG. 4 is a bottom view of the eating utensil assembly of FIG. 1.
Figure 5:
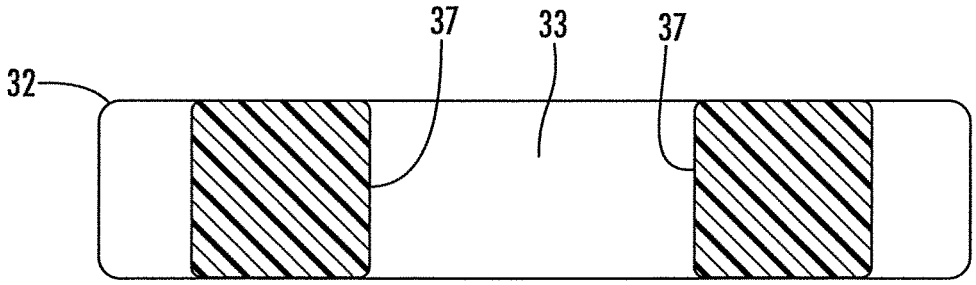
FIG. 5 is an enlarged cross-sectional view of a portion of the eating utensil assembly taken along line 5-1 of the eating utensil assembly of FIG. 2.
Figure 6:
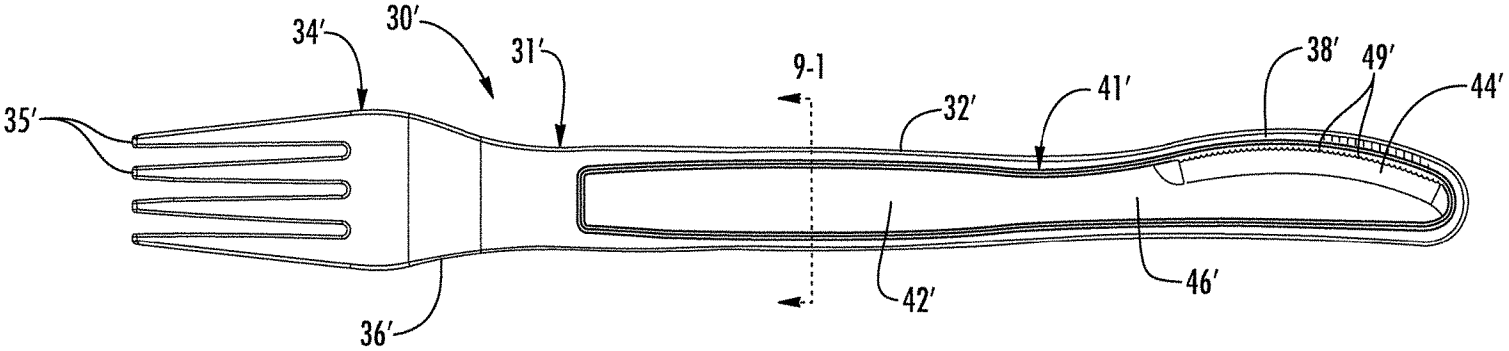
FIG. 6 is a top view of the eating utensil assembly according to another embodiment.
Figure 7:
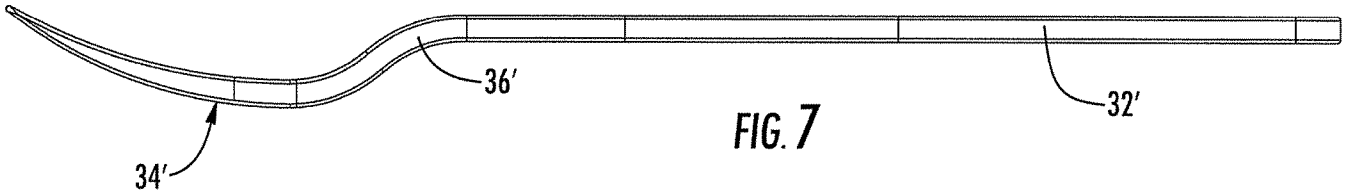
FIG. 7 is a side view of the eating utensil assembly of FIG. 6.
Figure 8:
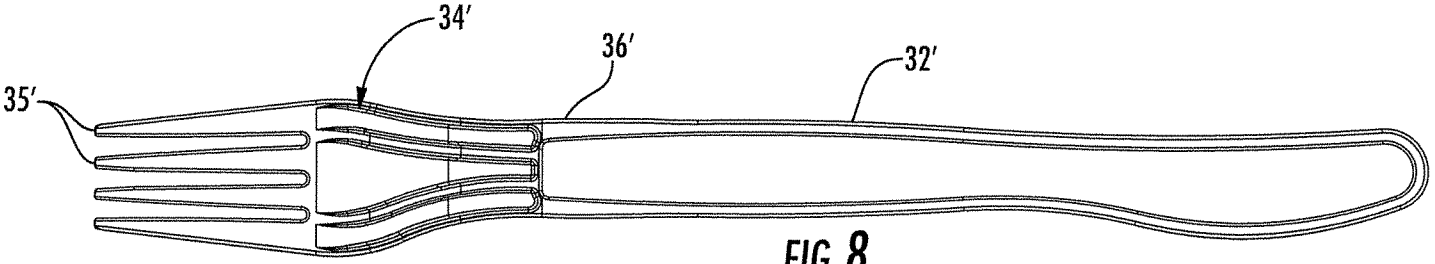
FIG. 8 is a bottom view of the eating utensil assembly of FIG. 6.
Figure 9:
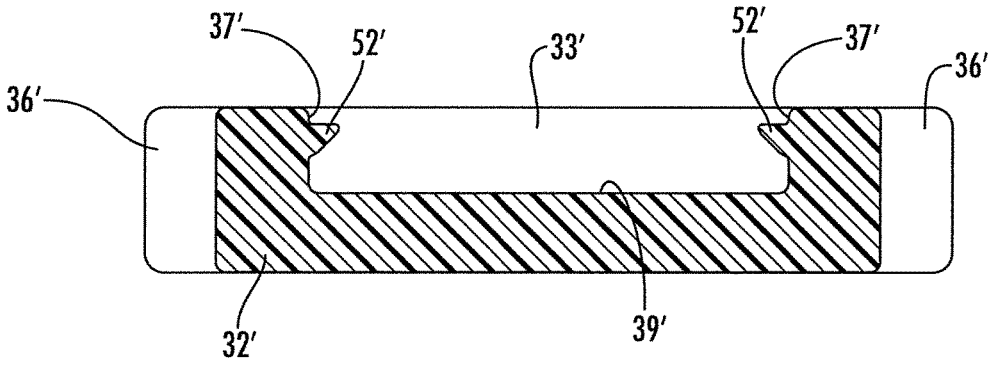
FIG. 9 is an enlarged cross-sectional view of a portion of the first eating utensil taken along line 9-1 of the eating utensil assembly of FIG. 6.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation, and numbers in increments of one-hundred are used to refer to like elements in different embodiments.

Referring initially to FIGS. 1-5, an eating utensil assembly 30 includes a first eating utensil 31 that is illustratively in the form of a fork. The first eating utensil 31 includes a first handle 32 having an opening 33 therein. The first handle 32 is illustratively planar in shape and also has an elongate shape.

A curved eating utensil head illustratively in the form of a fork head 34 is coupled to an end 36 of the first handle 32. In particular, the fork head 34 includes tines 35 that extend outwardly from the end 36 of the first handle.

The opening 33 in the first handle 32 is a through-opening. In other words, the opening 33 extends through the first handle 32. The opening 33 defines sidewalls 37. Exemplary dimensions of the first eating utensil 31 may be 8 inches long by about 1 inch wide by about 0.6 inches high, with the first handle 32 having dimensions of about 6 inches by 0.18 inches by 0.9 inches. Of course, the first eating utensil 31, including the first handle 32, may be other dimensions.

The eating utensil assembly 30 also includes a second eating utensil 41 removably carried by the first eating utensil 31, and more particularly, within the opening 33 in the first handle 32. The second eating utensil 41 is illustratively in the form of a knife and includes a second handle 42 and a cutting blade 44 that includes serrations 49 coupled to an end 46 of the second handle. The second eating utensil is carried within the opening 33 aligned lengthwise with the first handle 31. In other words, both the first and second eating utensils 31, 41 are aligned lengthwise.

Coupling bodies, for example, in the form of breakaway tabs 51 are in the opening and couple the first eating utensil 31 to the second eating utensil within the opening 33. More particularly, the opening 33 and the second eating utensil 41 have a same shape (i.e., knife shape), with the opening sized slightly larger than the second eating utensil to receive the second eating utensil therein. The first handle 32 may have an enlarged width portion 38 opposite the fork head 34 to accommodate an opening and thus the second eating utensil 41. Of course, the first handle 32 may have other or additional shapes to accommodate different sized and shaped second eating utensils 41, for example, knives.

The breakaway tabs 51 are spaced apart, along the perimeter of the opening 33 and between the sidewalls 37 and the second eating utensil 41. The breakaway tabs 51 conceptually maintain the second eating utensil 41 suspended within the opening 33. The breakaway tabs 51 may be sized, for example, to space the second eating utensil 41 from the first eating utensil 31 by about 0.02 inches or less. In other words, the breakaway tabs 51 may be 0.02 inches or less in size. Of course, the breakaway tabs 51 may be other dimensions, and each of the tabs need not be the same size.

The second eating utensil 41 is removably carried within the opening 33 flush with an upper surface of the first handle 32. The second eating utensil 41 may also be removably carried within the opening 33 flush with a lower surface of the first handle 32. In other words, the second eating utensil 41, when carried within the opening 33, may not protrude from the opening. This may allow more comfortable use and/or gripping when using only the fork or first eating utensil 31 without removing the second eating utensil 41, and which may give the appearance of a single or monolithic eating utensil.

The breakaway tabs 51, and the first and second eating utensils 31, 41 may be formed of plastic, for example, similar to that of disposable cutlery or utensils, as will be appreciated by those skilled in the art. However, the breakaway tabs 51, and the first and second eating utensils 31, 41 may be another material, for example, and may include metal.

In operation, a user desirous of using the second eating utensil 41, or knife, may "snap" the second eating utensil out from within the opening 33. A downward or upward force on the second eating utensil 41 relative to the first handle 32 causes the second eating utensil to separate from the breakaway tabs 51. The breakaway tabs 51 may additionally or alternatively separate from the sidewalls 37 in the opening 33 allowing the second eating utensil 41 to be used independently of the first eating utensil 31.

As will be appreciated by those skilled in the art, in addition to increased convenience, for example, the eating utensil assembly 30 described herein may be particularly advantageous for reducing disposable eating utensil waste.

In particular, the amount of material for the eating utensil assembly 30 yields two eating utensils. Additionally, since two or even three utensils are formed in a single utensil body, for example, a user would use a single eating utensil assembly reducing packaging and space, for example, for shipping and counter space at a restaurant. In other words, instead of using a separate utensil or a separate fork, knife, and/or spoon, a single eating utensil assembly 30 described herein may be used, reducing waste by as much as three-times, which also corresponds to reduced cost.

Referring now to FIGS. 6-10, in another embodiment, the opening 33' in the first handle 31' is a blind opening. In other words, the opening 33' does not extend all the way through the first handle 31'. The opening 33' defines sidewalls 37' and a floor or base 39'. The second eating utensil 41' is carried within the opening 33', and more particularly, carried by the base 39'.

A retaining protrusion 52' is coupled to the first handle and extending within the opening 33'. The retaining protrusion 52' may have a sloped or triangular shape (FIG. 9) for retaining the second utensil 41' within the opening 33'. Of course, the retaining protrusion 52' may have a different or other shape or shapes.

The retaining protrusion 52' extends within the opening 33' along a perimeter thereof. The retaining protrusion 52' does not extend adjacent the cutting blade 44'. In some embodiments, the retaining protrusion 52' may be continuous around the perimeter of the opening, or there may be multiple retaining protrusions, which may be spaced apart.

Figure 10:
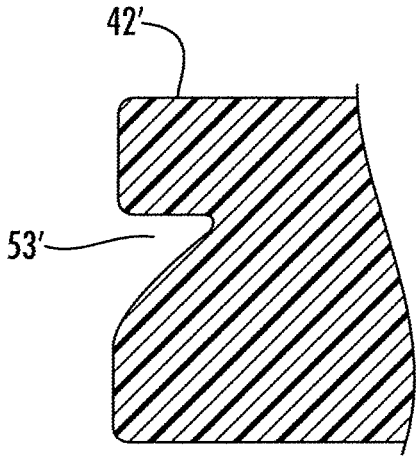
FIG. 10 is an enlarged cross-sectional view of a portion of the second eating utensil taken along line 9-1 of the eating utensil assembly of FIG. 6.

The second handle 42' has a recess 53' therein for receiving the retaining protrusion 52' (FIG. 10). The retaining protrusion 52' and the recess 53' cooperate so that the second eating utensil 41' is retained or coupled within the opening 33'. Conceptually, the second eating utensil 41' is "snapped" within the recess 33'.

In operation, and where the eating utensil assembly 30' is plastic, for example, polystyrene, or other pliable material, removal of the second eating utensil 41' may be accomplished by applying downward pressure to the ends 36', 56' of the first eating utensil, or more particularly, the first handle 32', which causes the second eating utensil to "snap" out of the opening 33'. In other embodiments, for example, where the eating utensil assembly 30' is metal or other more rigid material, a cut-out or tab may be in the second handle 42' to allow a user's finger, for example, to pry between the base 39' and the second handle. Of course, other or additional retaining and removal techniques may be used as will be appreciated by those skilled in the art.

It should be understood that while breakaway tabs 51 and a through-opening 33 have been described with the embodiment illustrated with respect to FIGS. 1-5, and a retaining protrusion 52' and a blind opening 33' have been described with respect to the embodiment in FIGS. 6-10, in some embodiments, the breakaway tabs may be used with the blind opening. Similarly, in other embodiments, the retaining protrusion 52' may be used with the through-opening 33.

Figure 11:
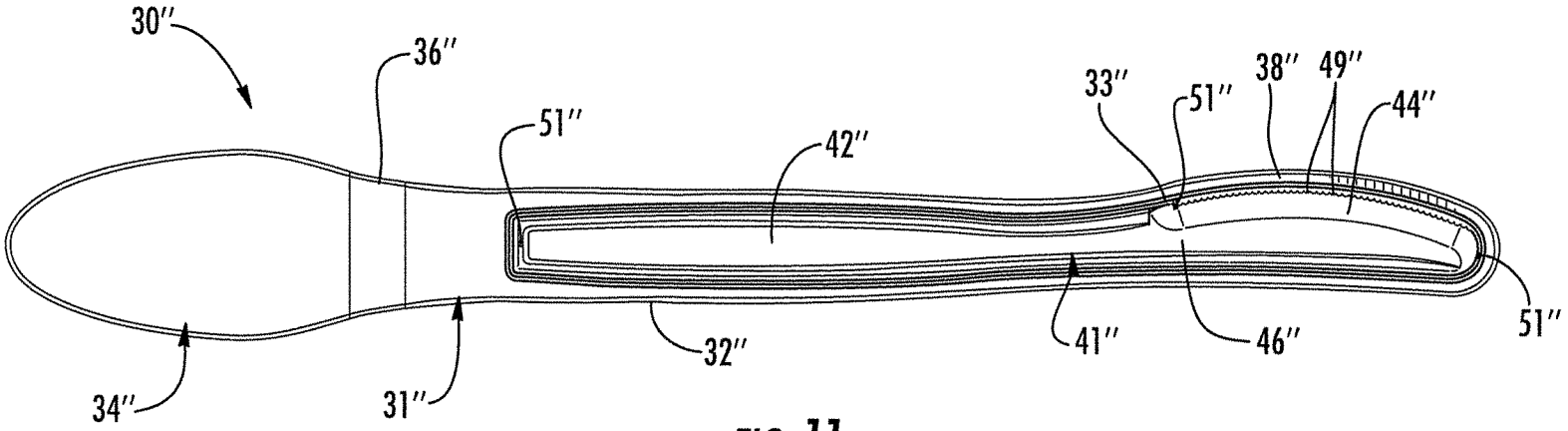
FIG. 11 is a top view of an eating utensil assembly in accordance with another embodiment.
Figure 12:
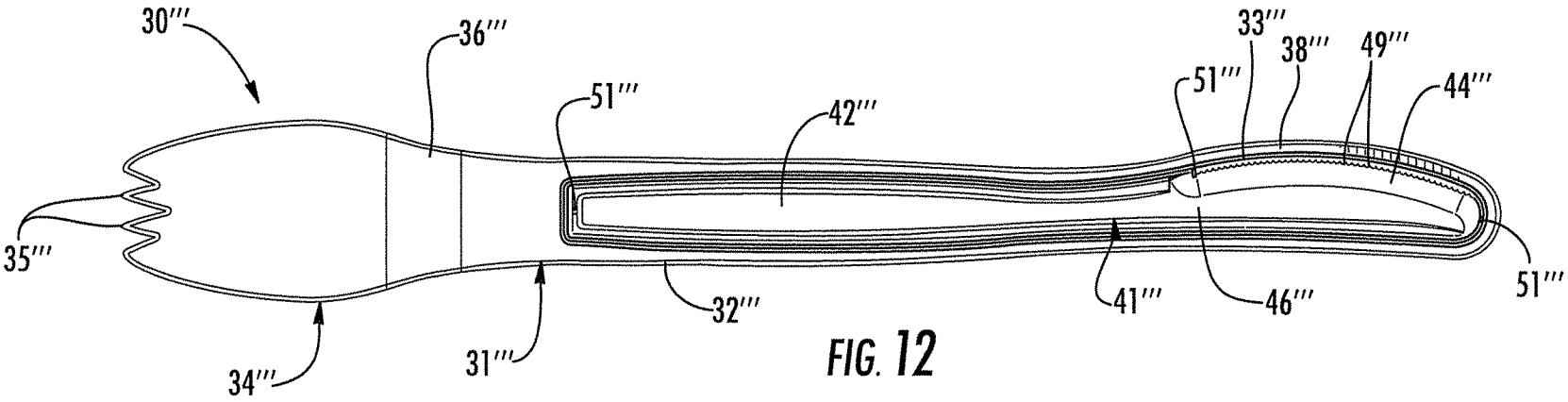
FIG. 12 is a top view of an eating utensil assembly in accordance with yet another embodiment.
Figure 13:
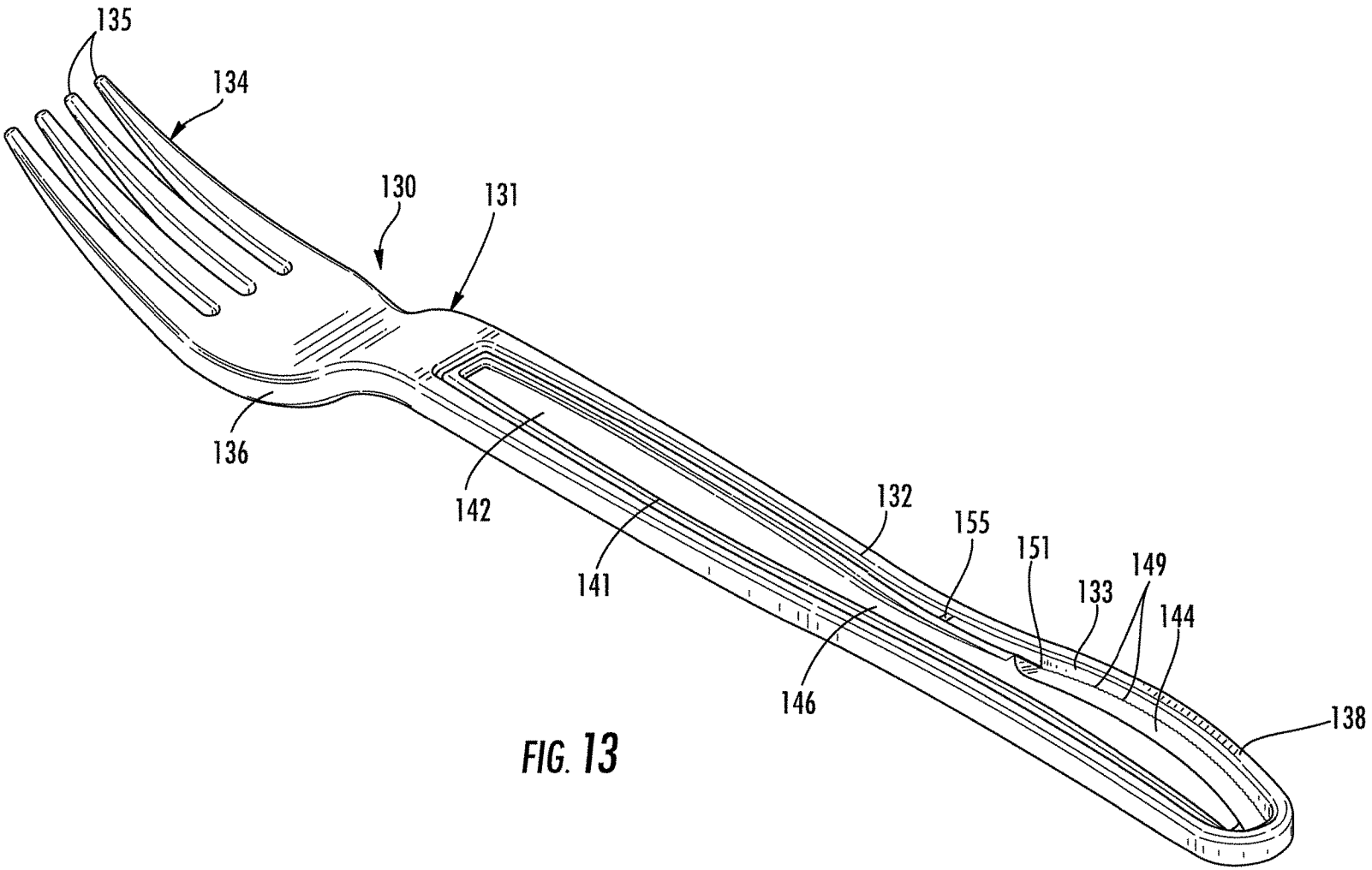
FIG. 13 is an enlarged perspective view of an eating utensil assembly according to another embodiment.
Figure 14:
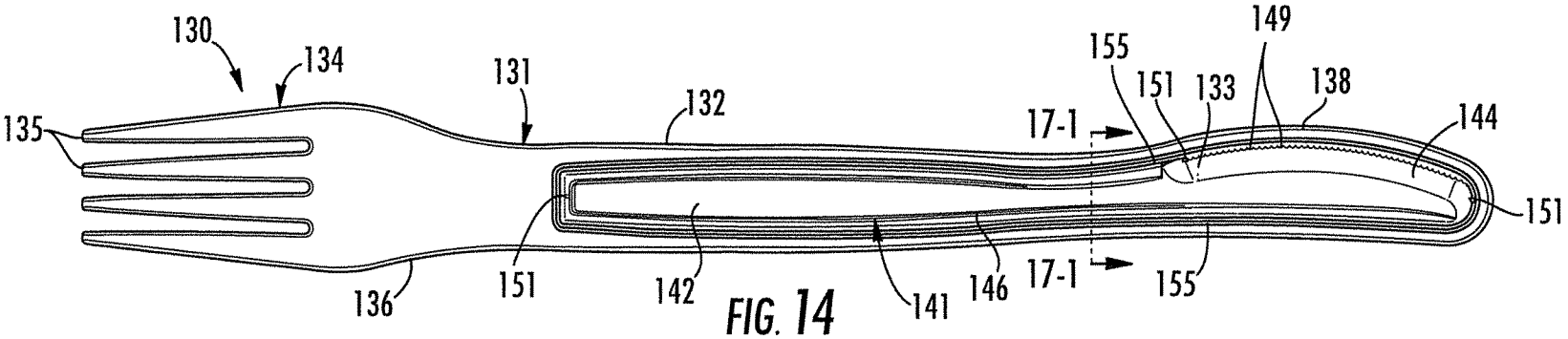
FIG. 14 is a top view of the eating utensil assembly of FIG. 13.
Figure 15:
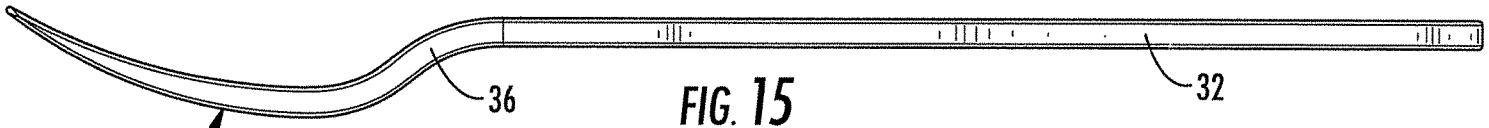
FIG. 15 is a side view of the eating utensil assembly of FIG. 13.
Figure 16:
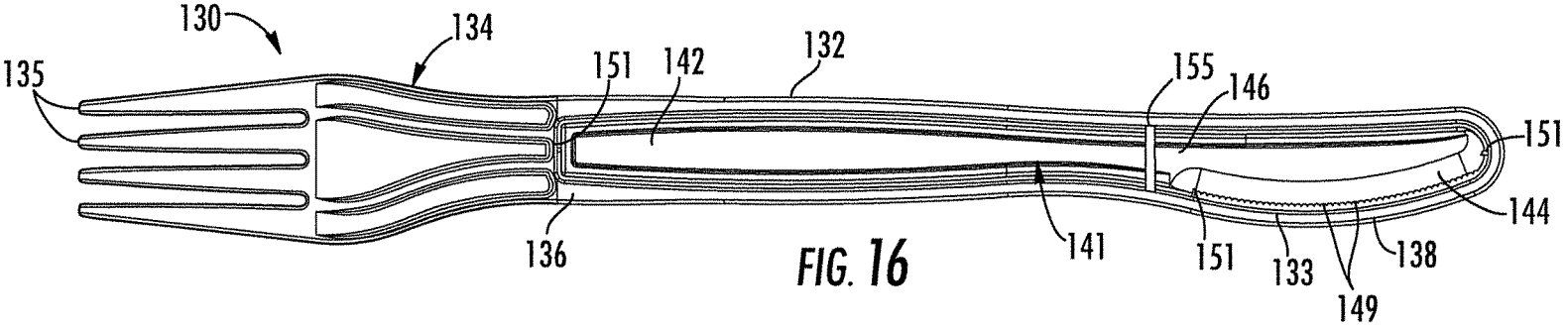
FIG. 16 is a bottom view of the eating utensil assembly of FIG. 13.
Figure 17:
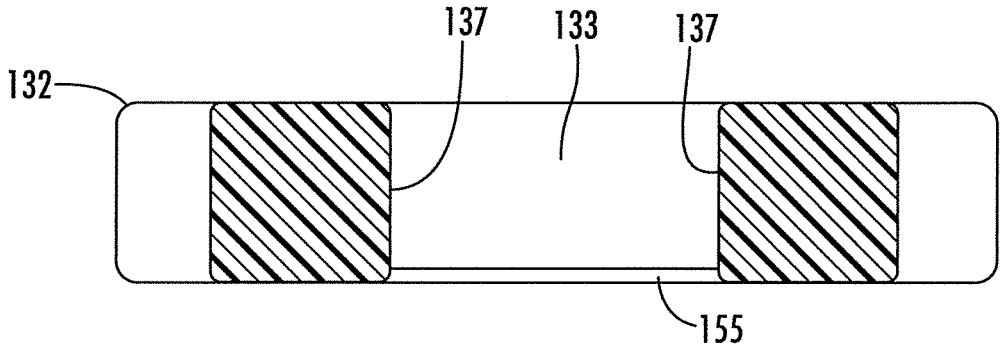
FIG. 17 is an enlarged cross-sectional view of a portion of the eating utensil assembly taken along line 17-1 of the eating utensil assembly of FIG. 14.
Figure 18:
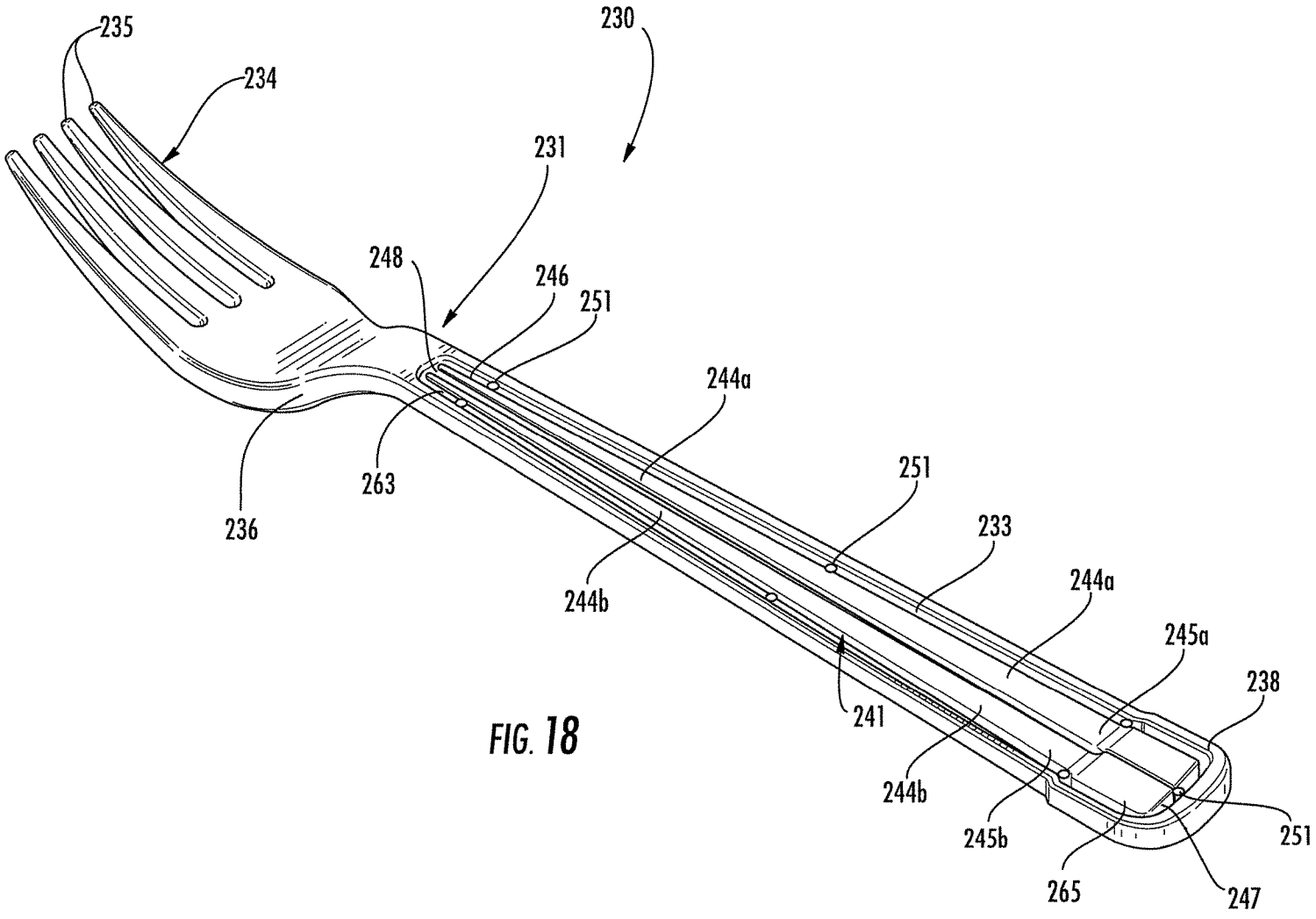
FIG. 18 is an enlarged perspective view of an eating utensil assembly according to another embodiment.

Referring now to FIGS. 11 and 12, in other embodiments, the first eating utensil 31" may be in the form of a spoon and the curved eating utensil head may be a curved or rounded food container 34" coupled to the end 36" of the first handle 32" (FIG. 11). In yet another embodiment, the first eating utensil 31'" may be in the form of a spork and the curved eating utensil head may be a curved or rounded food container 34'" with tines 35'" extending from the curved food container (FIG. 12). Other elements of the eating utensil assemblies 30" and 30'" illustrated are similar to those previously described with respect to FIGS. 1-5.

A method aspect is directed to a method of making an eating utensil assembly 30. The method includes forming a first eating utensil 31 that includes a first handle 32 having an opening 33 therein and an eating utensil head 34 coupled to an end 36 of the first handle and having a curved shape. The method includes forming a second eating utensil 41 to be removably carried by the first eating utensil 31 within the opening 33 in the first handle 32, and including a second handle 42 and a cutting blade 44 coupled to an end 46 of the second handle 42.

Referring now to FIGS. 13-17, in another embodiment, a support member 155 is coupled across the opening 133 adjacent the bottom of the first eating utensil 131. The support member 155 illustratively has a rectangular shape and is coupled to the first handle 132 between opposing sidewalls 137 of the opening 133. The support member 155 may have another shape.

The second eating utensil 141 is carried within the opening 133 by the support member 155 and coupled within the opening 133 by the coupling bodies or breakaway tabs 151. In some embodiments, the support member 155 may be "tacked" to the handle 142 of the second eating utensil 141 so that it also acts as a coupling body or breakaway tab. Other and/or additional support members 155 may be included, but it may be desirable to maintain the support members relatively small in size and number so as to not overly increase the weight of the eating utensil assembly 130.

Exemplary dimensions of the support member 155 are 8.7 mm long (i.e., across the perimeter of the opening 133) by 1 mm (along a length of the first handle 132 of the first eating utensil 131) wide by 0.75 mm thick. In some embodiments, there may be no breakaway tabs 151 along the perimeter of the opening 133 so that the second eating utensil 141 is removably coupled within the opening by the support 155.

The support member 155 may be particularly advantageous for increased structural rigidity, particularly during use. For example, without the support member 155, and once the second eating utensil 141 is removed from the opening 133, during use, the sidewalls 137, or the adjacent portions of the first handle 132 of the first eating utensil 130, may bend together from the pressure of holding or using the first eating utensil. The support member 155 provides increased rigidity and reduces bending of the sidewalls 137 toward one another.

Similar to the embodiments described above with respect to FIGS. 1-5, in operation, a user desirous of using the second eating utensil 141, or knife, may "snap" the second eating utensil out from within the opening 133. Either a downward force to the second eating utensil 141 on either side of the support member 155, or an upward force on the second eating utensil 141 relative to the first handle 132 causes the second eating utensil to separate from the breakaway tabs 151. Accordingly, the second eating utensil 141 may be removed upwardly or pushed through the opening 133 on either side of the support member 155 for use. It should be noted that the support member 155 may be used in addition to other features and embodiments, for example, the eating utensil assembly described above with respect to FIGS. 1-5 and FIGS. 11-12.

A method aspect is directed to a method of making an eating utensil assembly 130. The method includes forming a first eating utensil 131 that includes a first handle 132 having an opening 133 therein, a support member 155 coupled to the first handle across the opening, and an eating utensil head 134 coupled to an end of the first handle and having a curved shape. The method also includes forming a second eating utensil 141 to be removably carried by the support member 155 within the opening 133 in the first handle 132. The second eating utensil 141 includes a second handle 142 and a cutting blade 144 coupled to an end of the second handle.

Figure 19:
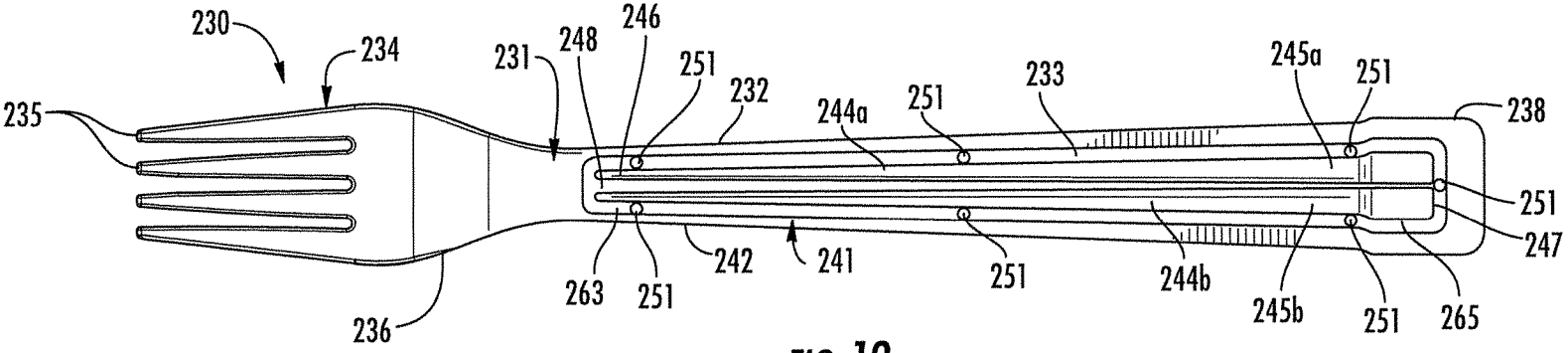
FIG. 19 is a top view of the eating utensil assembly of FIG. 18.
Figure 20:
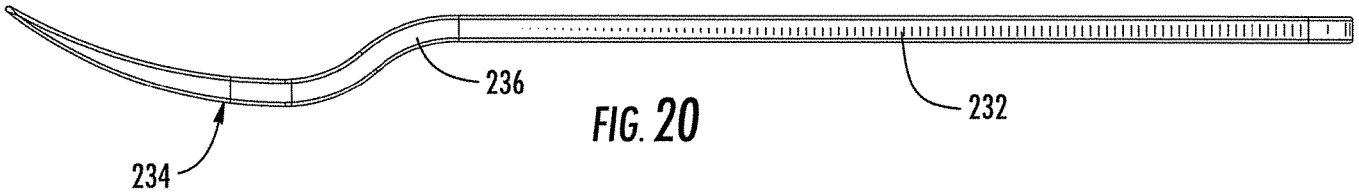
FIG. 20 is a side view of the eating utensil assembly of FIG. 18.
Figure 21:
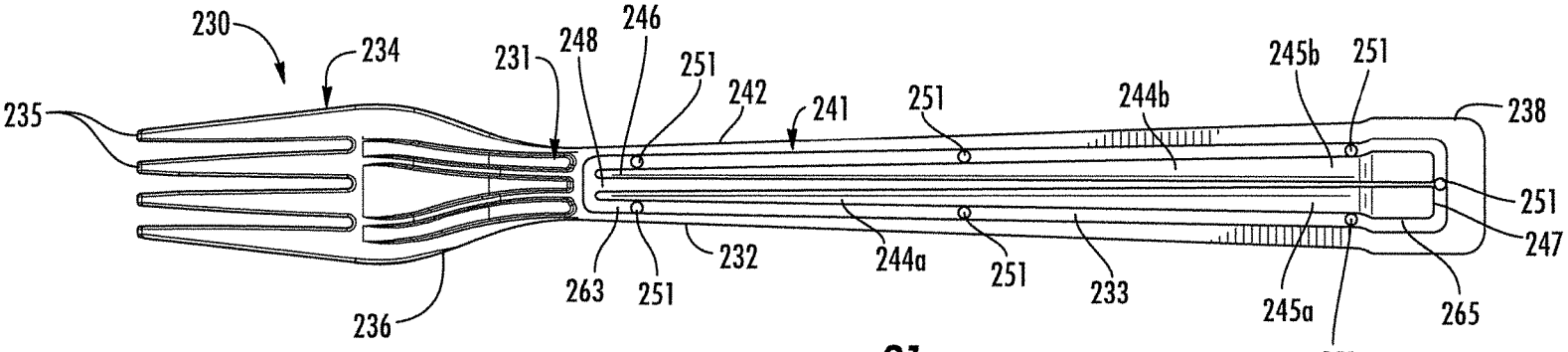
FIG. 21 is a bottom view of the eating utensil assembly of FIG. 18.

Referring now to FIGS. 19-21, in another embodiment, the eating utensil assembly 230 includes a first eating utensil 231 that includes a first handle 232 having a through-opening 233 therein. The first handle 232 and the through-opening 233 each having a proximal end 236, 262 and an enlarged width distal end 238, 265 that is enlarged relative to the proximal end to define a first handle contour and a through-opening contour, respectively. Illustratively, the first handle contour matches the through-opening contour. A first eating utensil head 234, which is illustratively in the form of a curved eating utensil head, and more particularly, a fork-head, is coupled to the proximal end 236 of the first handle 232. The fork head 234 includes tines 235 that extend outwardly from the proximal end 236 of the first handle 232. In some embodiments, the first eating utensil head 234 may be coupled to the enlarged width distal end 238 of the first handle 232. Similar to the embodiments described above, the first handle 232 is illustratively planar in shape and also has an elongate shape.

Figure 22:
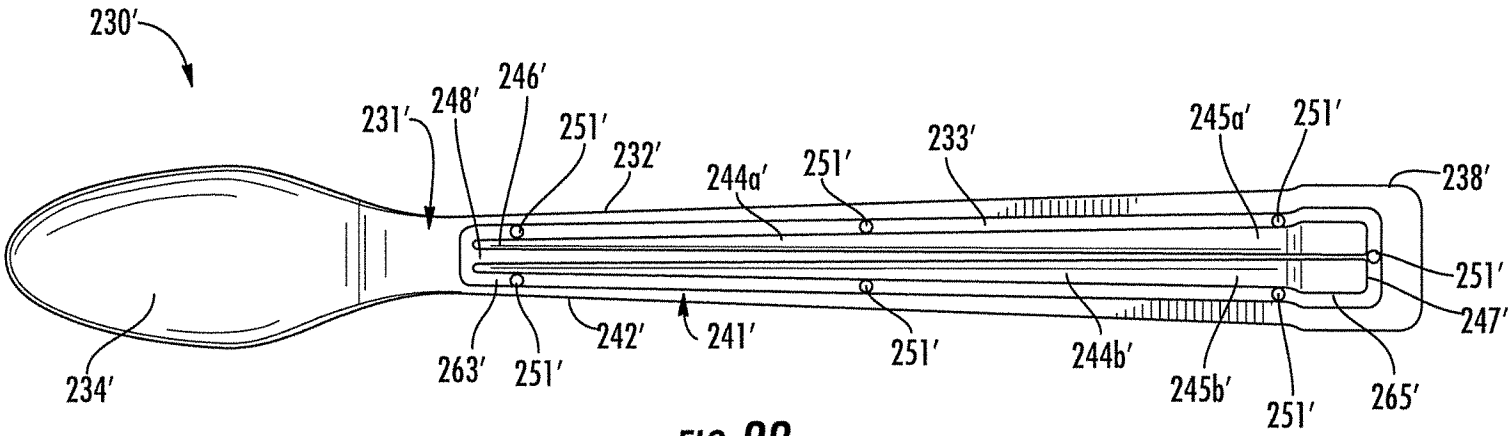
FIG. 22 is a top view of an eating utensil assembly in accordance with another embodiment.
Figure 23:
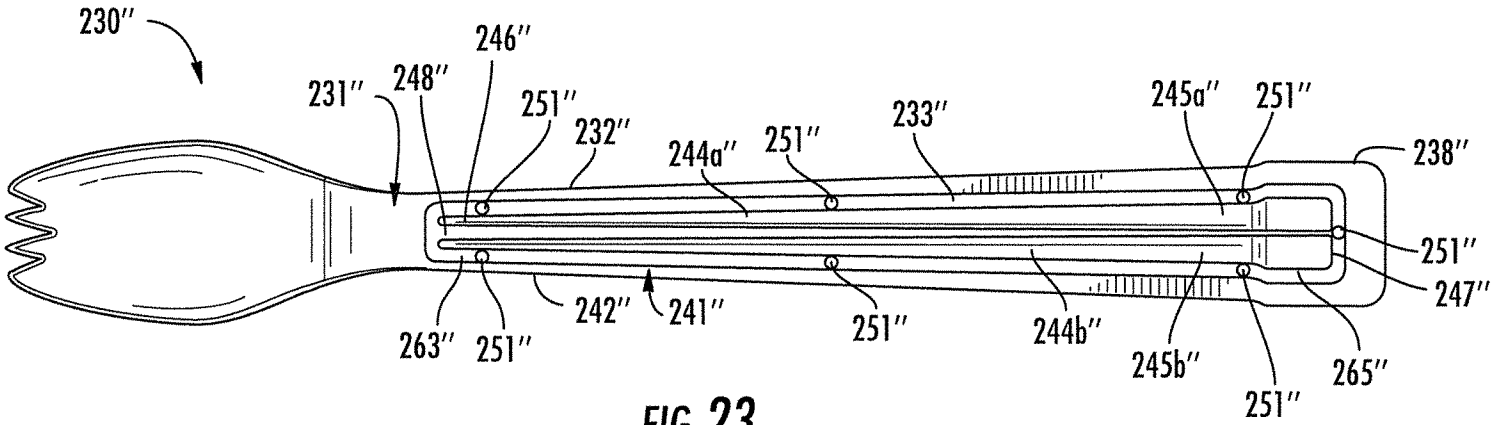
FIG. 23 is a top view of an eating utensil assembly in accordance with another embodiment.

Referring briefly to FIGS. 22-23 in other embodiments, the first eating utensil 231' may be in the form of a spoon and the curved eating utensil head may be a curved or rounded food container 234' coupled to the proximal end 236' of the first handle 232' (FIG. 22). In yet another embodiment, the first eating utensil 231" may be in the form of a spork and the curved eating utensil head may be a curved or rounded food container 234" with tines 235" extending from the curved food container (FIG. 23). Other elements of the eating utensil assemblies 230' and 230" illustrated are similar to those previously described with respect to FIGS. 19-21.

A second eating utensil 241 is removably carried by the first eating utensil 230 within the through-opening 233 in the first handle 231. More particularly, the second eating utensil 241 extends a length of the first handle 232 from the proximal end 263 of the through-opening 233 to the enlarged width distal end 265 of the through-opening. In some embodiments, the second eating utensil 241 may not extend the length of the first handle 232, but instead extend partially along the length of the first handle. The second eating utensil 241 is illustratively flush with an upper surface of the first handle 232. By being flush and not protruding above the first handle 232, a user who may, for example, not desire to use the second eating utensil 241 and leave it carried within the through-opening 233, experience increased comfort when holding the eating utensil assembly 230.

The second eating utensil 241 is illustratively in the form of chopsticks and includes a pair of sticks 244*a*, 244*b*, each having a tapered shape. Each of the pair of sticks 244*a*, 244*b* has a same length, however, in some embodiments, each of the pair of sticks may have a different size and/or shape. The second eating utensil 241 or pair of sticks 244*a*, 244*b* may advantageously be plastic, for example, which generally lends itself well to disposable utensils and is relatively lightweight. Of course, the second eating utensil 241 may be another type of material, for example, wood, metal, etc.

Figure 24:
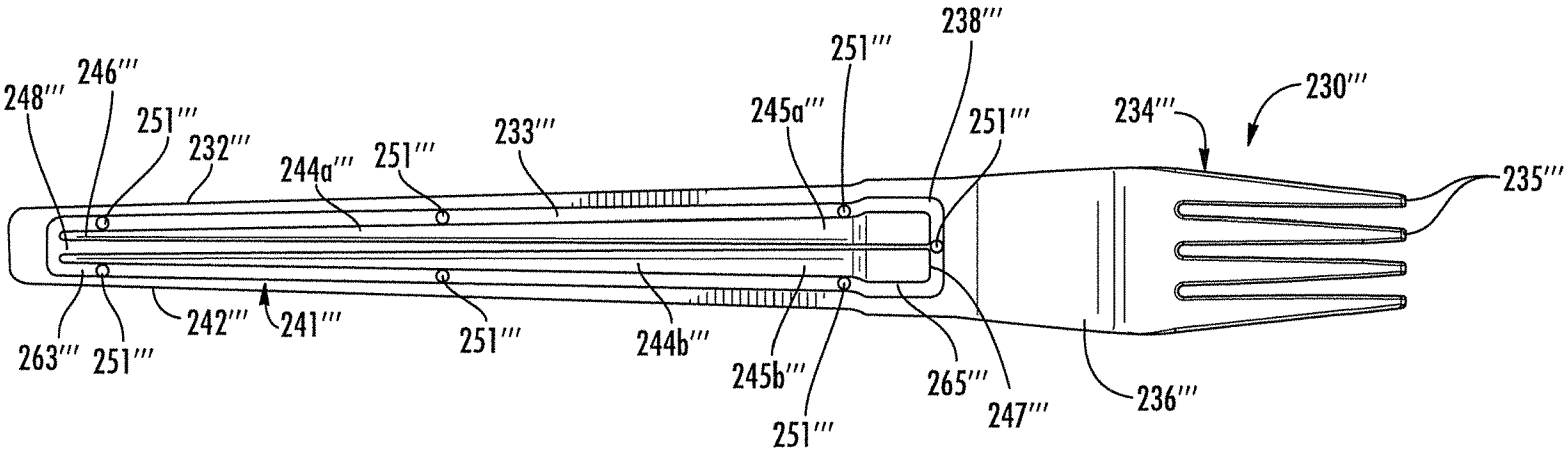
FIG. 24 is a top view of an eating utensil assembly in accordance with another embodiment.

The second eating utensil 241 has a distal end 246 and an enlarged proximal end 247 that is enlarged relative to the distal end of the second eating utensil to define a second eating utensil contour (e.g., having an overall tapered shape). The second eating utensil contour matches the first handle and through-opening contours. The enlarged proximal end 247 of the pair of sticks 244*a*, 244*b* is illustratively adjacent the enlarged width distal ends 238, 265 of the first handle 232 and the through-opening 233, respectively. Referring briefly to FIG. 24, an embodiment where the first eating utensil head 232''' is coupled to the enlarged width distal end 238''' of the first handle 232''' is illustrated. The contour or shape of the second eating utensil 241 will be described in further detail below.

Figure 25:
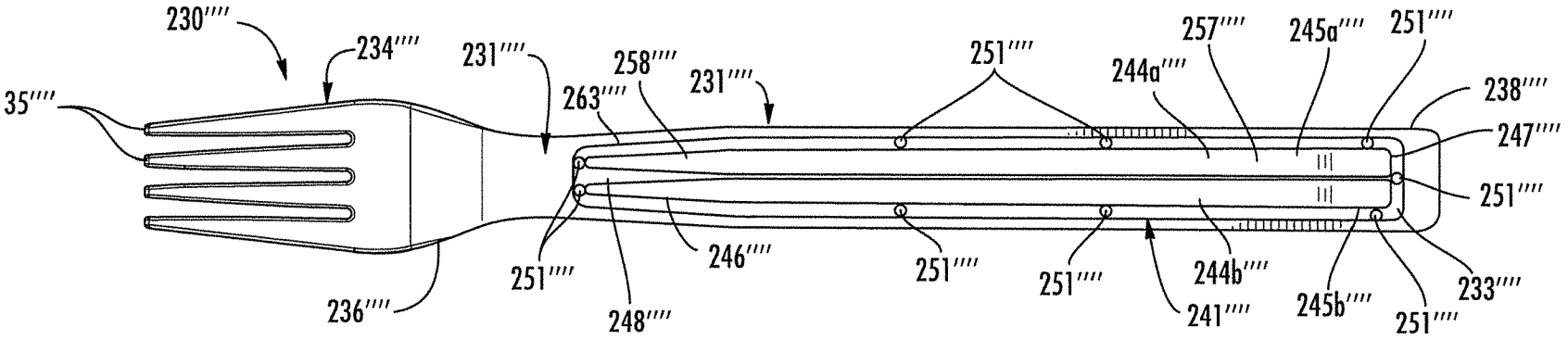
FIG. 25 is a top view of an eating utensil assembly in accordance with another embodiment.

Having a tapered shape, each of the pair of sticks 244*a*, 244*b* has an enlarged proximal end 245*a*, 245*b* whereby each of the pair of sticks is coupled together. For example, each of the pair of sticks 244*a*, 244*b* illustratively has a rectangular shaped enlarged proximal end 245*a*, 245*b* to permit relatively easy mating and provide increased coupling area with the other of the pair of sticks. The pair of sticks 244*a*, 244*b* are coupled together along a surface of the rectangular shaped enlarged ends 245*a*, 245*b*. As a result of the tapered shape of the pair of sticks 244*a*, 244*b* along with the coupling arrangement, the pair of sticks are spaced apart from each other adjacent a distal end 246 thereof. In other words, there is a space 248 between each of the pair of sticks 244*a*, 244*b* adjacent the distal end 246. The rectangular shaped enlarged proximal ends 245*a*, 245*b* of each of the pair of sticks 244*a*, 244*b* may be broken away from the rest of their respective stick, for example, by way of a score line, perforation, or other technique to facilitate breakaway. The broken away rectangular shaped enlarged ends 245*a*, 245*b*, which despite being broken away from the rest of the stick may still be coupled together, may be used as a rest for the pair of sticks so that the pair of sticks does not contact a table surface, for example. In other embodiments, the pair of sticks 244*a*, 244*b* may not be removably coupled to one another, but instead, spaced apart along the length thereof. Moreover, referring briefly and additionally to FIG. 25, it should be understood that the pair of sticks 244*a*, 244*b* may be tapered along the entire length thereof, or in some embodiments along a portion thereof, for example, a lower portion 257"" while the upper portion 258"" remains straight or not-tapered (FIG. 25).

The pair of sticks 244*a*, 244*b* is formed as a monolithic unit. The pair of sticks 244*a*, 244*b* may be formed as a monolithic unit along with the rest of the eating utensil assembly 230. In other words, the eating utensil assembly 230 may be integrally molded, for example, of plastic, to define a monolithic unit or eating utensil assembly. The pair of sticks 244*a*, 244*b* may have other shapes and may be coupled together by other and/or additional coupling techniques. The pair of sticks 244*a*, 244*b* may include wood, metal, plastic, and/or other material or combination of materials.

Breakaway tabs 251 removably couple the second eating utensil 241 to the first eating utensil 231. The breakaway tabs 251 are spaced apart between the second eating utensil 241 and the first eating utensil 231 along a perimeter of the through-opening 233. The breakaway tabs 251 may be equally spaced about along the perimeter in some embodiments. However, in other embodiments, the breakaway tabs 251 may be spaced in another arrangement, for example, to facilitate removal from the through-opening and/or to increase retention strength within the through-opening. The breakaway tabs 251, may be, similarly to the first and second eating utensils 231, 241, plastic and integrally molded therewith to define a monolithic unit. The breakaway tabs 251 may be another material and may not necessarily be the same material as either or both of the first and second eating utensils 231, 241. In some embodiments, there may be a breakaway tab 251 between the spaced apart sticks 244*a*, 244*b* adjacent the distal end 248.

Additionally, in some embodiments, the enlarged proximal end 245*a*, 245*b* of the pair of sticks 244*a*, 244*b* may be adjacent the proximal ends 246, 263 of the through-opening 233 and first handle 231. In such an embodiment, as will be appreciated by those skilled in the art, the breakaway tabs 251, because of the matching contours, may be increased in size adjacent the tapered proximal end of the pair of sticks 244*a*, 244*b*.

In operation, a user desirous of using the second eating utensil 241, or knife, may "snap" the second eating utensil out from within the opening 233. A downward or upward force on the second eating utensil 241 relative to the first handle 232 causes the second eating utensil to separate from the breakaway tabs 251. The breakaway tabs 251 may additionally or alternatively separate from sidewalls in the opening 233 allowing the second eating utensil 241 to be used independently of the first eating utensil 231. During use or when use of the second eating utensil 241 is desired, following a pushing down or snapping out of the second eating utensil from the through-opening, a user may pull-apart the thinned, tapered, or distal ends 245*a*, 245*b* of the pair of sticks 244*a*, 244*b*. The pulling apart may cause the coupled together pair of sticks 244*a*, 244*b* to snap or break apart, or separate for use as chopsticks.

As will be appreciated by those skilled in the art, in addition to increased convenience, for example, the eating utensil assembly 230 described herein may be particularly advantageous for reducing disposable eating utensil waste. In particular, the amount of material for the eating utensil assembly 230 yields two eating utensils. Additionally, since two or even three utensils are formed in a single utensil body, for example, a user would use a single eating utensil assembly reducing packaging and space, for example, for shipping and counter space at a restaurant. In other words, instead of using a separate utensil or a separate fork, knife, chopsticks, and/or spoon, a single eating utensil assembly 230 described herein may be used, reducing waste by as much as three-times, which also corresponds to reduced cost.

A method aspect is directed to a method of making an eating utensil assembly 230. The method includes forming a first eating utensil 231 that includes a first handle 232 having a through-opening 233 therein. The first handle 232 and the through-opening 233 each have a proximal end 236, 263 and enlarged width distal end 238, 265 that is enlarged relative to the proximal end to define a first handle contour and a through-opening contour, respectively. The first handle contour matches the through-opening contour. The first eating utensil 231 also includes and a first eating utensil head 234 coupled to one of the proximal and distal ends 236, 238 of the first handle. The method also includes forming a second eating utensil 241 removably carried by the first eating utensil 231 within the through-opening 233 in the first handle 232. The second eating utensil 241 has a distal end 246 and an enlarged width proximal end 247 that is enlarged relative to the distal end of the second eating utensil to define a second eating utensil contour. The second eating utensil contour matches the first handle and through-opening contours, and the second eating utensil 241 includes a pair of sticks 244*a*, 244*b* each having a tapered shape. The method also includes forming a plurality of breakaway tabs 251 to removably couple the second eating utensil 241 to the first eating utensil 231.

While several embodiments have been described herein, it should be appreciated that elements and features of any embodiments may be used along with other elements and features from other embodiments. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An eating utensil assembly comprising:

a first eating utensil comprising a first handle having a through-opening therein, said first handle and the through-opening each having a proximal end and enlarged width distal end that is enlarged relative to the proximal end to define a first handle contour and a through-opening contour, respectively, the first handle contour matching the through-opening contour, and a first eating utensil head coupled to one of the proximal and distal ends of said first handle;

a second eating utensil removably carried by said first eating utensil within the through-opening in said first handle, said second eating utensil having a distal end and an enlarged proximal end that is enlarged relative to the distal end of said second eating utensil to define a second eating utensil contour, the second eating utensil contour matching the first handle and through-opening contours, said second eating utensil comprising a pair of sticks each having a tapered shape; and a plurality of breakaway tabs removably coupling said second eating utensil to said first eating utensil.

2. The eating utensil assembly of claim 1 wherein each of said pair of sticks has a same length.

3. The eating utensil assembly of claim 1 wherein said pair of sticks are coupled together at the enlarged proximal end thereof.

4. The eating utensil assembly of claim 1 wherein said pair of sticks are spaced apart from each other adjacent the distal end thereof.

5. The eating utensil assembly of claim 1 wherein said second eating utensil defines a monolithic unit.

6. The eating utensil assembly of claim 1 wherein said second eating utensil extends a length of said first handle from the proximal end of the through-opening to the enlarged width distal end of the through-opening.

7. The eating utensil assembly of claim 1 wherein said plurality of breakaway tabs, said first eating utensil, and said second eating utensil define a monolithic unit.

8. The eating utensil assembly of claim 1 wherein said plurality of breakaway tabs are spaced apart between said second eating utensil and said first eating utensil along a perimeter of the through-opening.

9. The eating utensil assembly of claim 1 wherein said second eating utensil is removably carried within the through-opening flush with an upper surface of said first handle.

10. The eating utensil assembly of claim 1 wherein said first eating utensil head has a curved shape.

11. The eating utensil assembly of claim 1 wherein said first eating utensil head comprises a plurality of tines.

12. The eating utensil assembly of claim 1 wherein said first eating utensil head comprises a rounded container.

13. An eating utensil assembly comprising:

a first eating utensil comprising a first handle having a through-opening therein, said first handle and the through-opening each having a proximal end and enlarged width distal end that is enlarged relative to the proximal end to define a first handle contour and a through-opening contour, respectively, the first handle contour matching the through-opening contour, and a first eating utensil head coupled to one of the proximal and distal ends of said first handle;

a second eating utensil removably carried by said first eating utensil and extending a length of said first handle from the proximal end of the through-opening to the enlarged width distal end of the through-opening, said second eating utensil having a distal end and an enlarged proximal end that is enlarged relative to the distal end of said second eating utensil to define a second eating utensil contour, the second eating utensil contour matching the first handle and through-opening contours, said second eating utensil comprising a pair of sticks each having a tapered shape and a same length; and a plurality of breakaway tabs removably coupling said second eating utensil to said first eating utensil.

14. The eating utensil assembly of claim 13 wherein said pair of sticks are coupled together at the enlarged proximal end thereof.

15. The eating utensil assembly of claim 13 wherein said pair of sticks are spaced apart from each other adjacent the distal end thereof.

16. The eating utensil assembly of claim 13 wherein said second eating utensil defines a monolithic unit.

17. The eating utensil assembly of claim 13 wherein said plurality of breakaway tabs, said first eating utensil, and said second eating utensil define a monolithic unit.

18. The eating utensil assembly of claim 13 wherein said plurality of breakaway tabs are spaced apart between said second eating utensil and said first eating utensil along a perimeter of the through-opening.

19. A method of making an eating utensil assembly comprising:

forming a first eating utensil comprising a first handle having a through-opening therein, the first handle and the through-opening each having a proximal end and enlarged width distal end that is enlarged relative to the proximal end to define a first handle contour and a through-opening contour, respectively, the first handle contour matching the through-opening contour, and a first eating utensil head coupled to one of the proximal and distal ends of the first handle;

forming a second eating utensil removably carried by the first eating utensil within the through-opening in the first handle, the second eating utensil having a distal end and an enlarged proximal end that is enlarged relative to the distal end of the second eating utensil to define a second eating utensil contour, the second eating utensil contour matching the first handle and through-opening contours, the second eating utensil comprising a pair of sticks each having a tapered shape; and forming a plurality of breakaway tabs to removably couple the second eating utensil to the first eating utensil.

20. The method of claim 19 wherein each of the pair of sticks is formed to have a same length.

21. The method of claim 19 wherein the pair of sticks are formed to be coupled together at the enlarged proximal end thereof.

22. The method of claim 19 wherein the pair of sticks are formed to be spaced apart from each other adjacent the distal end thereof.

23. The method of claim 19 wherein the second eating utensil is formed to define a monolithic unit.

* * * * *